United States Patent [19]

Kurtz

[11] 4,283,038

[45] Aug. 11, 1981

[54] MIRROR MOUNTING DEVICE

[76] Inventor: Thomas D. Kurtz, 1101 First Ave., Rock Falls, Ill. 61071

[21] Appl. No.: 76,958

[22] Filed: Sep. 19, 1979

[51] Int. Cl.[3] ..... A47G 1/24

[52] U.S. Cl. ..... 248/478; 248/316 A

[58] Field of Search ..... 248/316 A, 476, 477, 248/478, 488

[56] References Cited

U.S. PATENT DOCUMENTS

| | | | |
|---|---|---|---|
| 2,007,077 | 7/1935 | Cox | 248/477 X |
| 2,501,176 | 3/1950 | Jacobs | 248/316 A X |
| 2,532,162 | 11/1950 | Goss | 248/477 |
| 2,696,962 | 12/1964 | Goss | 248/477 |
| 3,237,898 | 3/1966 | Goss | 248/478 |
| 3,762,024 | 10/1973 | Gutner | 248/476 X |

*Primary Examiner*—William H. Schultz

*Attorney, Agent, or Firm*—Vernon J. Pillote

[57] ABSTRACT

A mirror mounting device comprising at least one mirror mounting bracket having a mounting plate portion and a mirror hook at one end of the mounting plate portion, and an elongated longitudinally channeled mounting strip having a lengthwise extending intermediate wall portion and flange portions along the lengthwise edges of the intermediate wall portion and outturned lip portions on the flange portions disposed in a plane parallel to but offset from the intermediate wall portion. The flange portions of the strip are formed with slots that register in a direction crosswise of the strip, and the mounting plate portion of the mirror mounting bracket extends through the registering pair of slots in the flange portions and between the intermediate wall portion and the first and second lip portions for adjustment in a direction crosswise of the mounting strip.

7 Claims, 7 Drawing Figures

MIRROR MOUNTING DEVICE

BACKGROUND OF THE INVENTION

Many wall mirrors are large and quite heavy and it is desirable to support such mirrors on the wall studs. However, the studs are frequently not located in the exact position where it is desired to locate the mirror mounting brackets, and it has heretofore been proposed for example as shown in U.S. Pat. Nos. 2,696,962 and 3,237,898, to provide elongated mounting strips having a length to span at least a pair of adjacent studs, and to mount the mirror mounting brackets on the mounting strip. It is necessary that at least some of the mirror mounting brackets be adjustable in a direction crosswise of the mounting strip, to enable movement of the mirror engaging hooks on the mounting brackets into engagement with the edge of the mirror, after the mirror has been positioned. In U.S. Pat. No. 2,696,962, a guide member was attached by rivets at a selected location on the mounting strip to provide guideways extending crosswise of the strip for adjustably receiving the mirror mounting bracket. This construction utilized a number of separate parts and required an assembly operation to mount the bracket guide member on the strip, and this significantly increased the overall cost of the mirror mounting device. In U.S. Pat. No. 3,237,898, the face of the mounting strip was transversely slotted and stamped or formed to provide transversely disposed guide flanges spaced from the front of the mounting strip for slidably receiving the mirror mounting bracket. The transverse slotting of the mounting strip, however, markedly weakened the mounting strip. U.S. Pat. Nos. 2,696,962 and 3,237,898 do disclose the provision of longitudinal ribs or flutes in the mounting strip in order to stiffen and rigidify the same. However, in both of these patents, the mirror mounting bracket is disposed at the front side of the mounting strip and the depth of the stiffening ribs or flutes in the mounting strip add to the spacing between the wall and the mirror mounting bracket and undesirably increase the spacing between the rear side of the mirror and the wall.

SUMMARY OF THE INVENTION

It is an object of the present invention to overcome the disadvantages of the prior mirror mounting devices by providing an elongated mounting strip when longitudinally channeled to rigidfy the same and in which the mirror mounting brackets are adjustably mounted directly on the mounting strip at a position intermediate the front and rear faces of the longitudinally channeled mounting strip in a manner to minimize weakening of the mounting strip and to reduce the overall spacing of the mirror from the wall.

Accordingly, the present invention provides a mirror mounting device comprising at least one mirror mounting bracket having a mounting plate portion and a mirror hook at one end of the mounting plate portion, and an elongated longitudinally channeled mounting strip having a lengthwise extending intermediate wall portion and first and second flange portions along the lengthwise edges of the intermediate wall portion and first and second outturned lip portions on the respective first and second flange portions disposed in a plane parallel to but offset from the intermediate wall portion a distance no less than the thickness of the mounting plate portion of the mirror mounting bracket, the flange portions of the strip having slots therein at corresponding locations to provide at least a pair of slots that register in a direction crosswise of the strip, and the mounting plate portion of the mirror mounting bracket extends through the registering pair of slots in the flange portions and between the intermediate wall portion and the first and second lip portions.

These, together with other objects, features and advantages of the present invention will become apparent from the following description when taken in conjunction with the accompanying drawings wherein.

Figure 1:
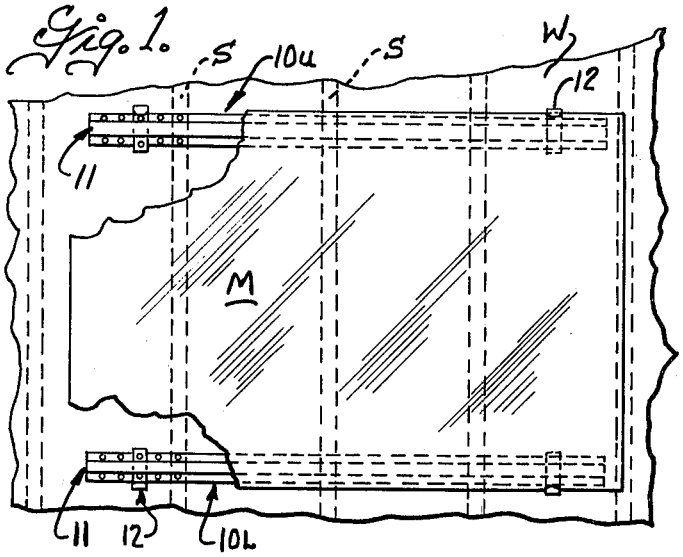
FIG. 1 is a fragmentary front elevational view illustrating a mirror mounted on a wall utilizing the mirror mounting device, and with parts broken away to illustrate details of construction.
Figure 2:
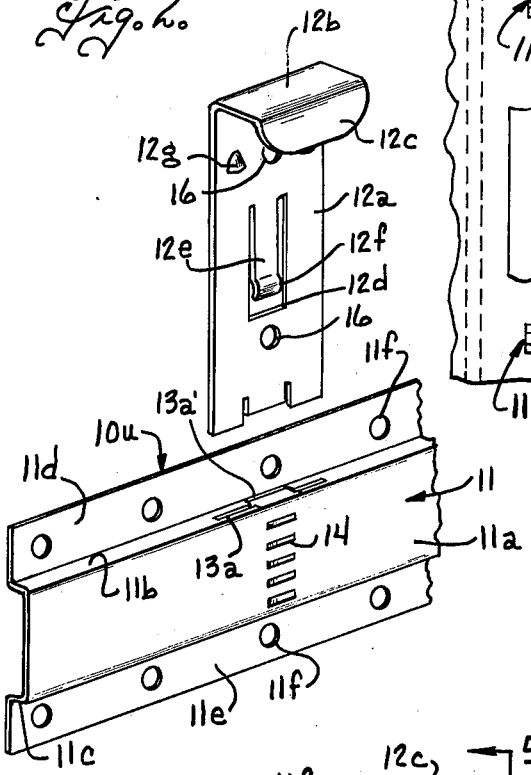
FIG. 2 is a fragmentary exploded perspective view of the mirror mounting device.

Referring now to FIG. 1 of the drawings there is illustrated a mirror M mounted on a wall W utilizing upper and lower mirror mounting devices designated 10U and 10L. The wall studs designated S are spaced apart and are frequently not located at the positions where it is desired to locate the mirror mounting brackets. The mirror mounting devices 10U and 10L accordingly include elongated mounting strips 11 having a length to span two or more of the studs and mirror mounting brackets 12 that are mounted on the mounting strips for engagement with the mirror. Preferably at least two mirror mounting brackets are mounted on each strip at a preset location relative to the ends of the strip and the strips are selected to have a length less than the length of the mirror so that the strips will be concealed by the mirror when the latter is in position. Although a mirror mounting bracket is herein shown provided adjacent each end of the mounting strip, it is apparent that one or more intermediate mirror mounting brackets can be used if desired for very long mirrors. In order to minimize the number of different parts that must be fabricated, the elongated mounting strips 11 and mirror mounting brackets 12 for the upper and lower mounting devices 10U and 10L are conveniently made the same, and like numerals are used herein to designate corresponding parts.

In accordance with the present invention, the elongated mounting strips 11 are longitudinally channeled to provide a lengthwise extending intermediate wall portion 11*a*, first and second flange portions 11*b* and 11*c* along the lengthwise edges of the intermediate wall portion and extending laterally from one side of the intermediate wall portion, and first and second outturned lip portions 11*d* and 11*e* on the respective first and second flange portions disposed in a plane parallel to and offset from the intermediate wall portions 11*a*. The mounting strips 11 are provided with fastener receiving openings 11*f* at spaced locations therealong, for example at one inch centers, for receiving fasteners such as nails or screws for attaching the mounting strips to the wall at locations that coincide with the studs S. The fastener receiving openings 11*f* are located in one and preferably both lip portions 11*d* and 11*e*.

Figure 5:
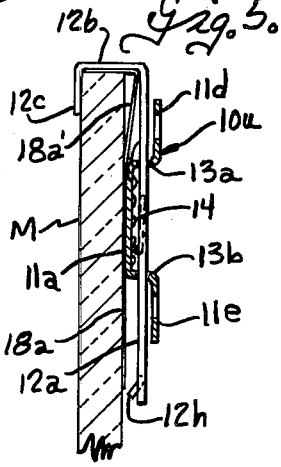
FIG. 5 is a vertical sectional view taken on the plane 5—5 of FIG. 3.
Figure 4:
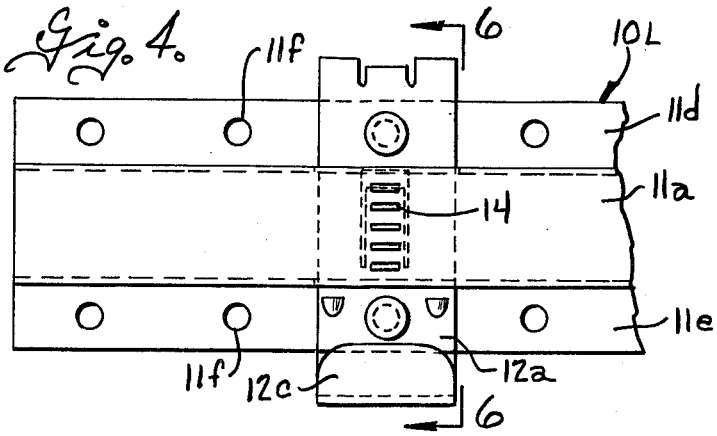
FIG. 4 is a fragmentary front elevational view of a mirror mounting device for use in mounting the lower edge of a mirror.
Figure 6:
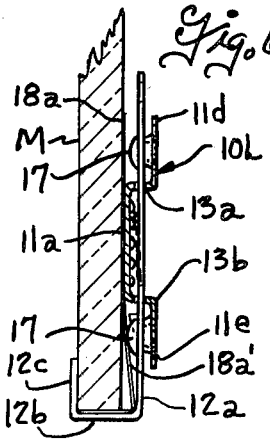
FIG. 6 is a fragmentary vertical sectional view taken on the plane 6—6 of FIG. 4.

The mirror mounting brackets 12 include a generally flat mounting plate portion 12*a*, a flange portion 12*b* that extends forwardly from one end of the mounting plate portion, and a lip portion 12*c* extending laterally from the flange portion 12*b* and in spaced relation to the mounting plate portion to form a mirror engaging hook at one end of the mounting plate portion. The mirror mounting brackets 12 are mounted directly on the mounting strips 11 at a location inwardly of the ends of the strip for adjustment in a direction crosswise the mounting strips. As best shown in FIGS. 5 and 6, the intermediate wall portion of the mounting strips is offset from the lip portions 11*d* and 11*e* a distance greater than the thickness of the mounting plate portion 12*a* of the mirror mounting bracket, and the flange portions 11*b* and 11*c* of the mounting strips are formed with slots 13*a* and 13*b* at correspondingly locations along the mounting strip to provide pairs of slots that register in a direction crosswise of the mounting strip. The slots 13*a* and 13*b* are elongated in a direction lengthwise of the strip and dimensioned to guidably receive the mounting plate portion 12*a* of the mirror mounting bracket so that the mirror mounting bracket is movable along a path crosswise of the mounting strip and between the intermediate wall portion 11*a* and the lip portions 11*d* and 11*e*.

The mirror mounting brackets 12 on the upper mounting device 10U must be adjusted crosswise of the mounting strip to engage the edge of the mirror after the mirror has been positioned. Provision is made for releasably retaining the mirror mounting brackets of the upper mounting device in engagement with the edge of the mirror after they have been adjusted. In the embodiment illustrated, the intermediate wall portion 11*a* of the mounting strip is formed with a row of detents designated 14 at the rear side thereof and the mounting plate portion of the rear mounting bracket is cut out as shown at 12*d* to provide an integral resilient tongue 12*e* that formed with a detent engaging nose 12*f* adjacent its free end. The detents 14 can conveniently be formed by embossing the intermediate wall portion as best shown 11*a* in FIGS. 3–6, and the detent engaging nose is arranged to engage the row of detents 14 on the intermediate wall portion of the wall mounting strip and to releasably hold the mirror mounting bracket in open position during installation of the mirror and to hold the mirror mounting bracket in a lowered or closed position, to retain the mirror in position after it is installed. At least the upper slot 13*a* is provided with relieved areas designated 13*a'* intermediate its ends to facilitate passage of the nose portion 12*f* during insertion of the mounting plate portion into the slot. Stops 12*g* are provided for limiting movement of the mirror mounting bracket in one direction relative to the mounting strip, and a second stop 12*h* is provided for limiting movement of the mirror mounting bracket in the other direction relative to the mounting strip. Stops 12*g* are conveniently formed by upsetting the mounting plate portion 12*a* to form protuberances at locations to engage one of the flange portions 11*b* on the mounting strip, when the mounting bracket is moved inwardly to a preselected position. Stop 12*h* is conveniently formed by notching the end of the mounting plate portion 12*a* to form a tab and then bending the tab laterally of the mounting plate portion on the mounting strip, so that the stop 12*h* is arranged to engage the other flange portion 11*c* on the mounting strip, to prevent accidental disassembly of the mounting bracket from the mounting strip.

The weight of the mirror is suspended from the mirror mounting brackets on the lower mirror mounting device 10L and it is desirable to positively anchor the lower mirror mounting bracket in a preselected position on the lower mounting strips. This is conveniently achieved by providing one or more holes 16 in the plate portion of the mounting bracket at locations to register with one or more of the fastener receiving openings 11*f* in the mounting strip, when the mirror mounting bracket is in a preselected position. A fastener is then inserted through the registering openings 16 and 11*f* to secure the mounting bracket in a fixed position on the lower mounting strip. This is preferably achieved by the use of one or more rivets 17 for securing the mounting bracket and mounting strips together. Alternatively, a wall mounting fastener such as a nail or screw, can be inserted through one set of registering openings 16 and 11*f* in the event the wall mounting bracket is in registry with one of the studs S.

Figure 7:
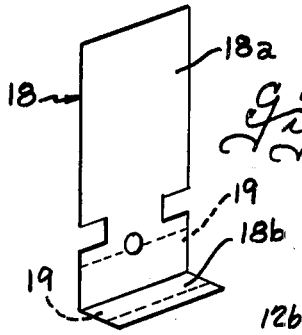
FIG. 7 is a perspective view of a mirror protecting pad for use with the mirror mounting device.
Figure 3:
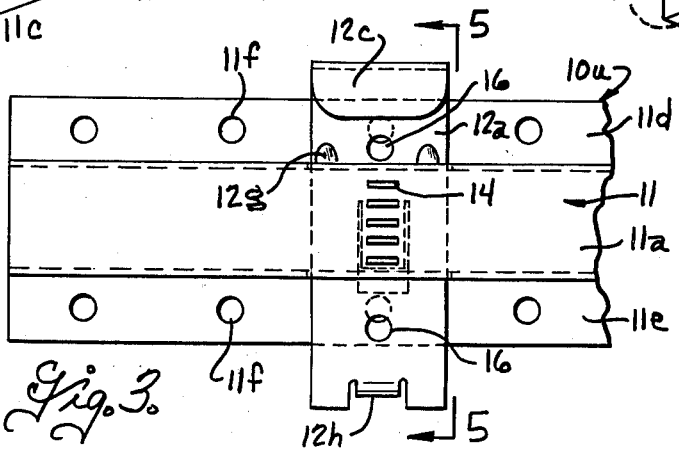
FIG. 3 is a fragmentary front elevational view of a mirror mounting device for use in mounting the upper edge of a mirror.

The intermediate wall portion 11*a* of the mounting strip provides a smooth support surface for the back of the mirror. However, it is desirable to provide a protective liner for the mirror mounting brackets to prevent scratching the rear mirrored surface. This is advantageously achieved by the use of a pad 18 FIG. 7 for example of plastic, card board or the like and including an elongated body 18*a* having a length corresponding to the length of the mounting plate portion 12*b* of the mirror mounting bracket, and a lateral flange 18*b* at one end adapted to underlie the flange portion 12*b* of the mirror mounting bracket. The body 18 is adapted to overlie the front face of the intermediate wall portion 11*a* of the mounting strip and one end portion 18*a'* of the body 18*a* is offset to extend along the projecting end of the mounting plate 12*a*. The pad is advantageously secured to the mirror mounting bracket by a pressure sensitive adhesive layer 19 on the back side of at least the flange 18*b*. The pressure sensitive adhesive can be applied in a strip to sheet stock to be used in forming the pads 18, and the pressure sensitive adhesive covered by a peelable protective sheet. After the pads are cut from the stock, the protective strip can be peeled off and the pad secured to the mounting bracket by merely pressing the pad into position. As is apparent, the pads 18 with pressure sensitive securing means can be secured to the mirror mounting brackets either by the manufacturer or by the mirror installer.

From the foregoing it is thought that the construction and use of the mirror mounting device will be readily understood. The mounting strips are made in stepped lengths, for example 24, 28, 36, 42 and 54 inch lengths and the mounting strips to be used are selected so as to be slightly shorter than the length of the mirror to be concealed when the mirror is in position. The lower mounting strip 10L is mounted on the wall at a level such that the hook portions on the lower mounting device 10L are at the desired elevation for the lower edge of the mirror and the strip is lengthwise positioned so as to be longitudinally centered with respect to the longitudinal centerline of the desired mirror position. Fasteners such as nails or screws are then inserted through those openings 11*f* in the mounting strip that register with the studs S to secure the lower strip to the wall. The upper mounting strip is similarly longitudinally centered but is vertically positioned at a level such that the hook portions on the mirror mounting brackets of the upper mirror mounting device 10U can be adjusted into and out of engagement with the upper edge of the mirror, when the mirror is positioned on the lower mounting device 10L. The lower edge of the mirror 10L is then positioned on the hook portings of the lower mirror mounting device 10L and the mirror mounting brackets on the upper mirror mounting device 10U are then moved downwardly into engagement with the upper edge of the mirror.

The embodiments of the invention in which an exclusive property or privilege is claimed are defined as follows:

1. A mirror mounting device comprising, at least one mirror mounting bracket having a mounting plate portion and a mirror hook at one end of the mounting plate portion, an elongated longitudinally channeled mounting strip having a lengthwise extending intermediate wall portion and first and second flange portions along the lengthwise edges of the intermediate wall portion extending laterally from one side of the intermediate wall portion and first and second outturned lip portions on the respective first and second flange portions disposed in a plane parallel to and offset from the intermediate wall portion a distance no less than the thickness of the mounting plate portion of the mirror mounting bracket, the first and second flange portions of the strip having slots therein at corresponding locations therealong to provide at least one pair of slots that register in a direction crosswise of the strip, the mounting plate portion of the mirror mounting bracket extending through the registering pair of slots in the first and second flange portions and between the intermediate wall portion and the first and second lip portions, and means including fastener receiving openings at spaced locations along the mounting strip for attaching the mounting strip to a wall.

2. A mirror mounting device according to claim 1 wherein said fastener receiving openings are in at least one of said lip portions.

3. A mirror mounting device according to claim 1 wherein said mounting plate portion of the mirror mounting bracket is slidable through the registering pair of slots for adjustment in a direction crosswise of the strip.

4. A mirror mounting device according to claim 3 including means on said intermediate wall portion and on the mounting plate portion of the mirror mounting bracket for releasably retaining the mirror mounting bracket in different adjusted positions.

5. A mirror mounting device according to claim 4 wherein said last mentioned means includes a row of detents on the itermediate wall portion and a resilient finger on the mounting plate portion of the mirror mounting bracket engageable with said row of detents.

6. A mirror mounting device according to claim 1 wherein said mounting strip and said mounting plate portion of the mirror mounting bracket have openings therein adapted to register when the mounting plate portion is in a preselected position crosswise of the mounting strip, and fastener means extending through said registering openings for securing the mirror mounting bracket in a fixed position on the mounting strip.

7. A mirror mounting device comprising upper and lower longitudinally channeled mirror mounting strips each having a lengthwise extending intermediate wall portion and first and second flange portions along the lengthwise edges of the intermediate wall portion extending laterally from one side of the intermediate wall portion and first and second outturned lip portions of the respective first and second flange portions disposed in a plane parallel to and offset from the intermediate wall portion, at least one upper and one lower mirror mounting bracket each having a mounting plate portion and a mirror hook at one end of the mounting plate portion, the upper and lower mounting strips each having slots formed in the first and second flange portions thereof at corresponding locations therealong to provide pairs of slots that register in a direction crosswise of the respective strip, the mounting plate portion of the upper mirror mounting bracket slidably extending through the registering pair of slots in the upper mounting strip, means on the intermediate wall portion of the upper mounting strip and on the mounting plate portion of the upper mirror mounting bracket for releasably retaining the upper mirror mounting bracket in different positions crosswise of the upper mounting strip, the mounting plate portion of the lower mirror mounting bracket extending through the registering pair of slots in the lower mounting strip, means for securing the lower mirror mounting bracket in a preselected position on the lower mounting strip, and means including fastener receiving openings at spaced locations along the upper and lower mounting strips for mounting the strips on a wall.

* * * * *